United States Patent [19]

Semp et al.

[11] Patent Number: 4,592,698

[45] Date of Patent: Jun. 3, 1986

[54] PROCESS FOR REMOVING COVERING MATERIAL FROM TOBACCO BALES

[75] Inventors: Bernard A. Semp; Robert B. Giovenco, both of Richmond, Va.

[73] Assignee: Philip Morris Inc., New York, N.Y.

[21] Appl. No.: 694,292

[22] Filed: Jan. 24, 1985

[51] Int. Cl.[4] ..... B65G 65/02

[52] U.S. Cl. ..... 414/786; 29/564.3; 83/53; 83/177; 83/924; 414/412

[58] Field of Search ..... 414/412, 786; 83/53, 83/177, 924; 29/564.3

[56] References Cited

U.S. PATENT DOCUMENTS 4,119,227 10/1978 Hafner et al. ..... 414/412

4,435,902 3/1984 Mercer et al. ..... 83/177 X

*Primary Examiner*—Robert G. Sheridan

*Attorney, Agent, or Firm*—Wayne M. Kennard

[57] ABSTRACT

The present invention is a process for removing covering material from a bale of, for example, Oriental tabacco leaves at production line speeds which causes only minimal damage to the underlying bale and only minimal contamination of the underlying bale with particles, fragments and/or fibers of the covering material.

18 Claims, 8 Drawing Figures

PROCESS FOR REMOVING COVERING MATERIAL FROM TOBACCO BALES

TECHNICAL FIELD

The present invention relates to a process for removing covering material from baled material. More specifically, the present invention relates to removing burlap and reinforcing string used to cover tobacco bales.

BACKGROUND ART

Oriental tobacco, particularly Turkish tobacco, is characterized by small leaf size (typically six inches long and three inches wide). The Oriental tobacco leaves in a bale of tobacco are typically stacked, then tied with reinforcing string, and finally covered with burlap. The loops of reinforcing string are spaced apart and substantially parallel to one another. The loops are tied transverse to the direction that the tobacco leaves are laid in the stack. The bales covered in this manner are then shipped to manufacturers for use in the production of the tobacco products. The manufacturers that receive the covered bales must be able to remove the burlap and reinforcing string in an expeditious manner to maintain ordinary production line speeds for the efficient production of tobacco products containing these leaves.

There are several methods for removing the burlap and reinforcing string currently being practiced. One method is to manually cut both the outer burlap covering and the plurality of loops of reinforcing string to uncover the underlying bale of Oriental tobacco leaves. This method has the disadvantage of being extremely slow for production line use. When enough men are used to satisfy the production line needs, this method has the disadvantage of being an extremely inefficient use of manpower.

Another method currently practiced is to use a large circular saw to cut through the entire bale. In this method, the covered bales of Oriental tobacco leaves are fed to the saw with the loops of reinforcing string disposed transverse to the plane of the saw blade. The saw cuts the entire bale in half, cutting the burlap and loops of reinforcing string along with the bale itself. The burlap and loops reinforcing string are then manually removed from the separate halves of Oriental tobacco bales.

The use of the saw to cut through the bale, the burlap, and loops of reinforing string has several disadvantages. For example, when the saw cuts through the bale the tobacco leaves in the path of the saw blade are also cut which is undesirable. Also when a circular saw is used fragments, particles and/or fibers of the reinforcing string and the burlap contaminate the tobacco leaves near the cut. These fragments, particles, and/or fibers can ultimately end up in finished tobacco products which is extremely undesirable.

The present invention provides a process for removing the burlap and loops of reinforcing string covering a bale of Oriental tobacco leaves which does not have the above addressed disadvantages.

DISCLOSURE OF INVENTION

The present invention is a process for removing covering material from a bale of tobacco leaves.

The tobacco bales which are typically processed in accordance with the process of the present invention are Oriental tobacco leaves which are covered with, for example, reinforcing string and a fabric material such as burlap. The process of the invention is characterized by properly orienting the covered tobacco bale on a conveying means for transport to a covering removal apparatus, conveying the covered tobacco bale to a covering material removal apparatus, introducing the covered bale into the covering removal apparatus, stopping the covered bale within the apparatus, engaging opposing ends of the covered bale with one of a pair of engagement means, respectively, and extending means from the respective engagement means to separately engage the burlap and reinforcing string covering the respective ends of the bale, lifting the covered bale held between the pair of engagement means, activating a water knife and moving it to a cutting position adjacent to the covered bale, rotating the covered bale with the water knife in the cutting position, cutting the burlap and each of loops of reinforcing string in the circumferential passage of the water knife around the covered bale during the rotating step, stopping rotation of the covered bale, deactivating the water knife and moving it from the cutting position, uncovering the underlying bale by moving the pair of engagement means away from the ends of the bale with the means engaging the burlap and reinforcing string extending therefrom still engaging the burlap and reinforcing string, removing the uncovered bale from the apparatus, releasing the burlap and reinforcing string from the engagement means, and removing the burlap and reinforcing string from the apparatus.

An object of the invention is to provide a process for removing burlap and loops of reinforcing string covering bales of tobacco leaves.

Another object of the invention is to provide a process for removing burlap and loops of reinforcing string covering a bale of tobacco leaves such that there is minimal damage to the underlying bale of Oriental tobacco leaves in the bale.

A still further object of the invention is to provide a process for removing burlap and loops of reinforcing string covering a bale of tobacco leaves at production line speeds such that contamination of the bale of tobacco leaves with fragments, particles and/or fibers of burlap and/or reinforcing string is prevented.

These and other objects of the invention will be disclosed more fully in the remaining portions of the disclosure.

BEST MODE FOR CARRYING OUT THE INVENTION

Figure 1:
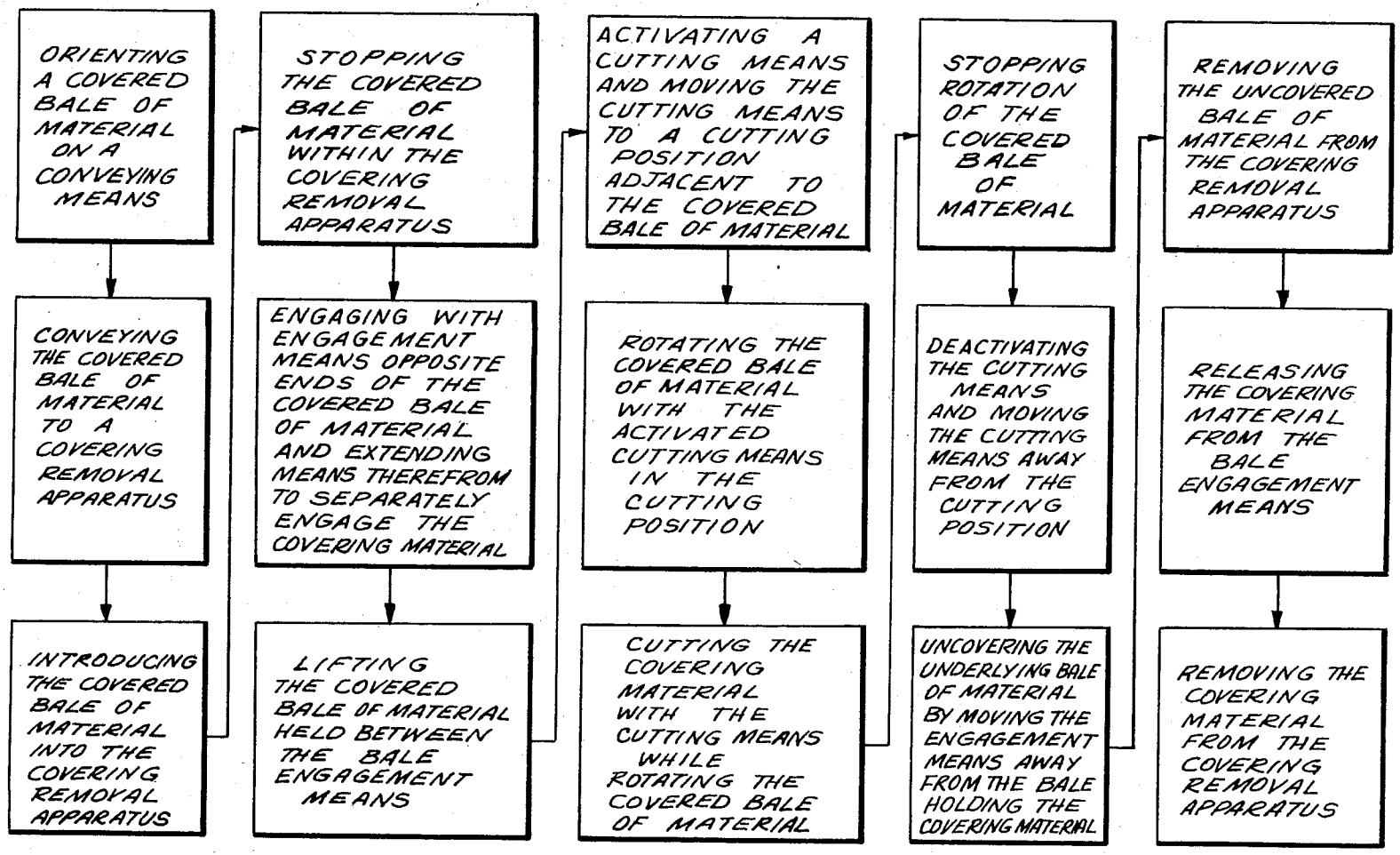
FIG. 1 shows a block diagram of the preferred embodiment of the process of the invention.

Referring to FIG. 1, the preferred embodiment of the process of the invention will be described. Prior to describing the process of the invention, the bales of tobacco leaves typically processed by the present invention and material covering such bales will be described.

The bales of tobacco typically processed by the present invention are bales of Oriental tobacco leaves. These bales are covered first by loops of reinforcing string that are spaced apart and parallel to one another. These loops of reinforcing string are disposed around the top, bottom and ends of the tobacco bale. Disposed over the tobacco bales having the loops of reinforcing string disposed thereon is an outer fabric covering material which is, for example, burlap. The bales of Oriental tobacco leaves covered in the above described manner are shipped to manufacturers of tobacco products. Although typically burlap forms the outer covering for the bales, other fabric material can be used.

Again referring to FIG. 1, the process for removing covering material from a bale of tobacco leaves will be described. In accordance with the process of the invention, a covered tobacco bale is removed from a place of storage and oriented on a conveying means for transport to a covering removal apparatus. In this step, the bale is oriented so that the loops of reinforcing string are transverse to the direction of movement of the conveying means. When so oriented, the loops of reinforcing string will be transverse to the direction of travel of the water knife during cutting step found subsequenly in the process. After the orienting step, the bales are conveyed to the covering removal apparatus on the conveying means. Following the conveying step, the bales are introduced into the apparatus on the conveying means with the loops of reinforcing string oriented as described in the orienting step. Once the introducing step is completed, the bale is stopped within the covering removal apparatus. Subsequent to the stopping step, each end of the covered bale is engaged respectively by one of a pair of engagement means. As the pair of engagement means engages the ends of the covered bales, means are extended from each of the engagement means to separately engage the loops of reinforcing string and burlap at the respective ends of the bale. After the engagement means are so positioned, the bale of tobacco is held between the two engagement means.

After the engaging step, the bale is lifted a predetermined distance above the conveying means it was resting upon. During or after the lifting step, a water knife is activated and moved to its cutting position adjacent to the covered bale. Following completion of the activating and moving step, the covered bale is rotated with the activated water knife in this cutting position. During the rotating step the water knife makes a circumferential cut in the outer burlap covering and cuts each of the loops of reinforcing string in two places. After the rotating step and cutting step, rotation of the bale is stopped. Subsequent to the stopping step, the water knife is deactivated and moved from the cutting position to a noncutting position away from the covered bale. Following the deactivating and moving step, the pair of engagement means are moved in respective directions away from the ends of the bale with the means extending therefrom still engaging the burlap and cut loops of reinforcing string. As the pair of engagement means move away from the respective ends of the bales, the cut burlap and loops of reinforcing string are removed from the underlying tobacco bales thereby uncovering the bale.

After the uncovering step, the uncovered bale is removed from the apparatus. During or after the removing step, during which the underlying uncovered bale is removed from the apparatus, the burlap and cut loops of reinforcing string are released by the engagement means. Following the releasing step, the cut burlap and reinforcing string are removed from the apparatus and the apparatus is ready to receive the next covered tobacco bale.

Figure 2:
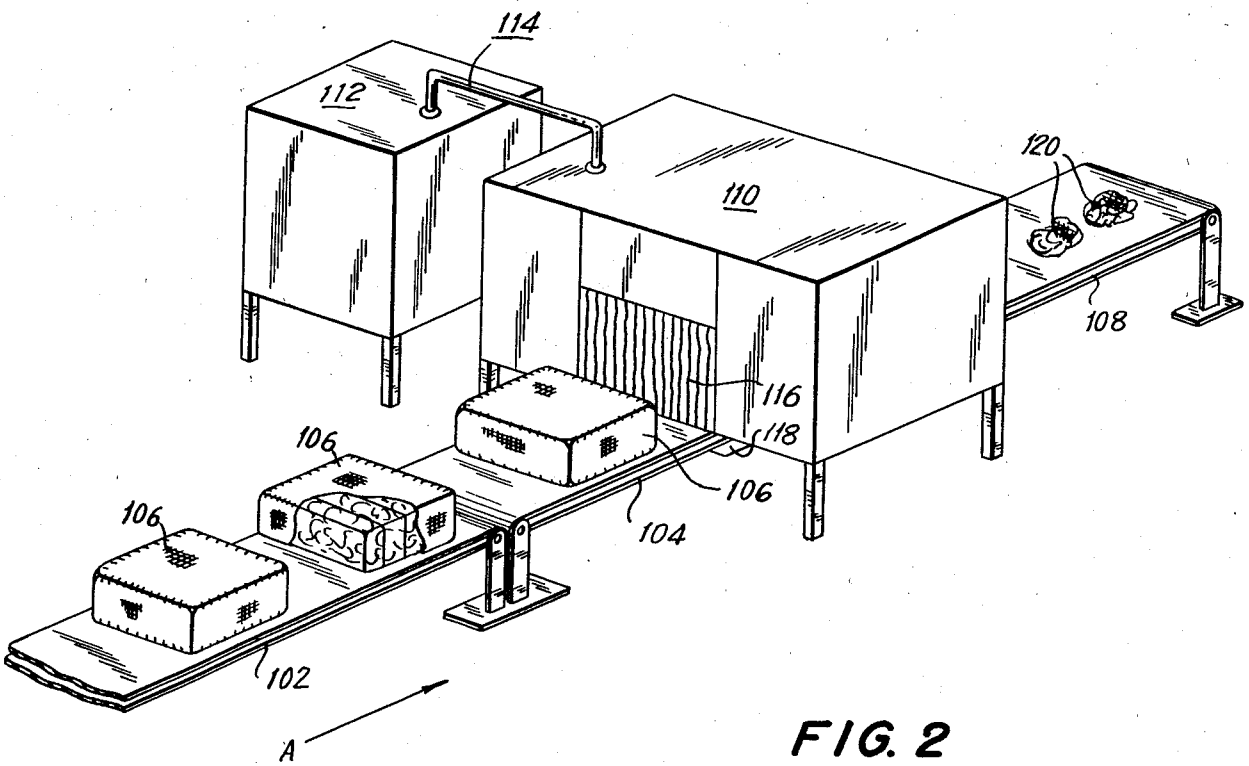
FIG. 2 shows a system for carrying out the preferred embodiment of the process of the invention.
Figure 3:
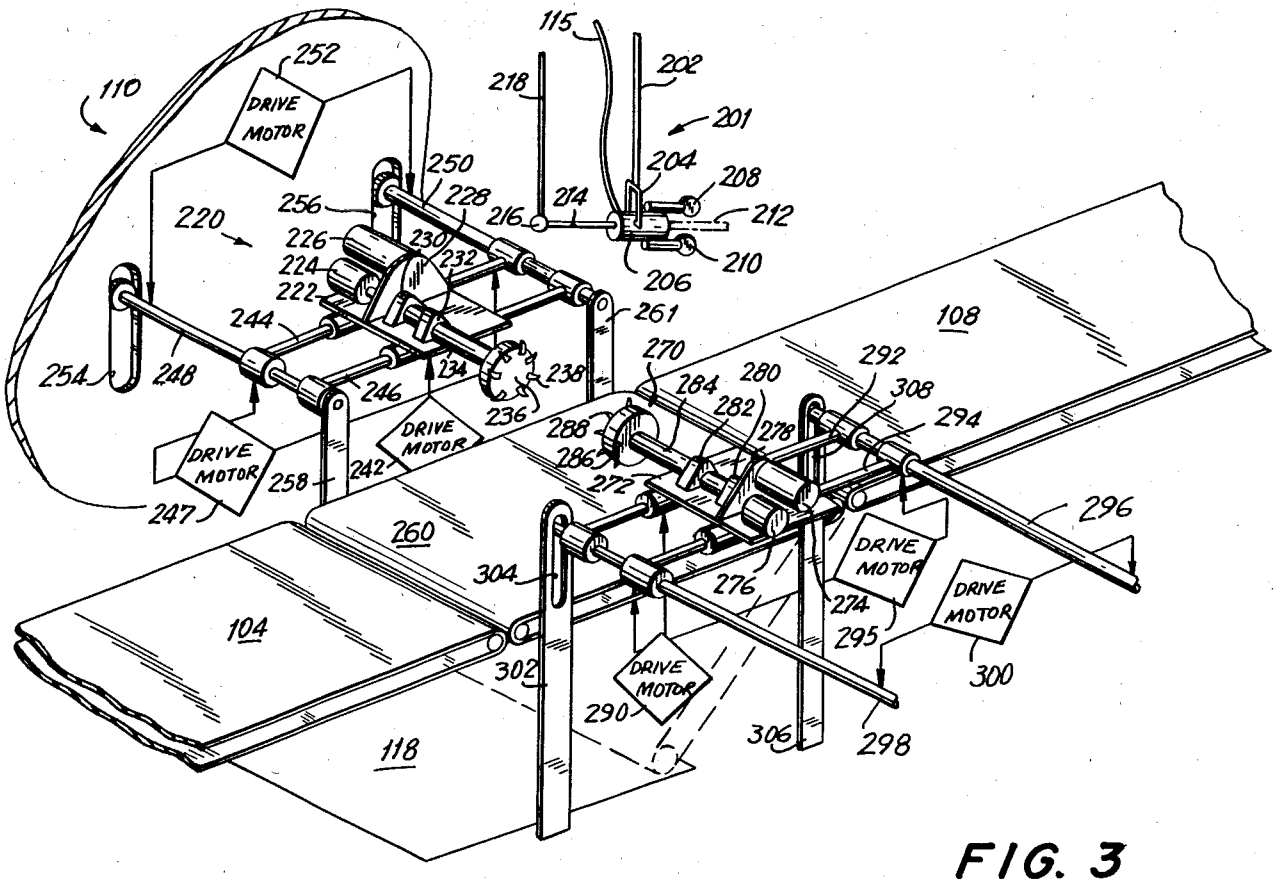
FIG. 3 shows the operating assemblies within the deburlapping and destringing apparatus of the system shown in FIG. 2.

Referring to FIGS. 2, 3, 4 and 5, a system for carrying out the preferred embodiment of the process of the invention will be described. As shown in FIG. 2, the system for carrying out the preferred embodiment of the process of the invention has deburlapping and destringing apparatus 110, water knife supply system 112 and conveyors 102, 104, 108 and 260 (FIG. 3).

In accordance with the process of the invention, a covered tobacco bale 106 is removed from a place of storage by conventional means and placed on conveyor 102. Upon placing covered bale 106 on conveyor 102, the bale is oriented so that the loops of reinforcing string are transverse to the direction of movement A of the bale on conveyor 102. The bale is oriented as described for carrying out other subsequent steps of the process of the invention. After the orienting step, covered bale 106 is conveyed via conveyors 102 and 104 to deburlapping and destringing apparatus 110.

At the end of the conveying step, covered bale 106 is introduced into apparatus 110 on conveyor 104 and, preferably, passes through flexible drapes 116 at the entrance opening of apparatus 110. A corresponding set of flexible drapes (not shown) are disposed at the exit opening of apparatus 110. The drapes confine the dust and moisture generated by operation of apparatus 110 within the apparatus.

After the introducing step, covered bale 106 is transferred to conveyor 260 (FIG. 3). Once covered bale 106 is transferred to conveyor 260, the bale moves a short distance on conveyor 260 and then conveyor 260 is stopped thereby stopping the movement of covered bale 106 in apparatus 110. Following this stopping step, covered bale 106 is disposed substantially between a pair of engagement means, for example cat's paw assemblies 220 and 270, disposed on opposite sides of conveyor 260.

Cat's paw assemblies 220 and 270 are substantially mirror images of one another on opposite sides of conveyor 260. It is to be understood that movements of one assembly are mirrored by the other assembly on the opposite side of conveyor 260. Since the assemblies are mirror images of one another, only assembly 220 will be described and the corresponding reference numerals for elements of assembly 270 will be indicated in parenthesis following those of assembly 220.

Cat's paw assembly 220 (270) has platform 222 (272) which supports the remainder of the assembly. Disposed on platform 222 (272) are drive shaft supports 230 and 232 (280 and 282) which support drive shaft 234 (284). Disposed at the distal end of drive shaft 234 (284) is cat's paw head 236 (286) which will be described in greater detail with reference to FIGS. 4 and 5. Disposed adjacent to drive shaft support 230 (280) and perpendicular to platform 222 (272) is plate 228 (278). Disposed on an opposite side of plate 228 (278) are cat's paw drive 224 (276) which causes cat's paw claws 238 (288) to extend from and retract into cat's paw head 236 (286), and cat's paw rotation motor 226 (274) which causes cat's paw head 236 (286) to rotate in a predetermined direction.

Platform 222 (272) is slidably disposed on platform rods 244 and 246 (292 and 294). Drive motor 242 (290), shown in block form, causes platform 222 (272) to move to any desired position along platform rods 244 and 246 (292 and 294). Drive motor 242 (290) can be any conventional type of motor conventionally connected to platform 222 (272) for driving same. The movement of platform 222 (272) along platform rods 244 and 246 (292 and 294) by drive motor 242 assists in centering cat's paw head 236 (286) for engagement with an end of the covered bale stopped on conveyor 260.

Platform rods 244 and 246 (292 and 294) are slidably disposed on main support rods 248 and 250 (296 and 298). Platform rods 244 and 246 (292 and 294) having assembly 220 (270) disposed thereon are driven along main support rods 248 and 250 (296 and 298) by drive motor 247 (295), shown in block form. Drive motor 247 (295) drives cat's paw head 236 (286) of assembly 220 (270) into and out of engagement with the end of covered bale 106. Drive motor 247 (295) can be of any conventional type of motor conventionally connected to platform rods 244 and 246 (292 and 294).

Main support rods 248 and 250 (296 and 298) have flange members disposed at each of their respective ends. The flange members disposed at the first ends of main support rods 248 and 250 (296 and 298) are received in slots in the wall of apparatus 110 having openings 254 and 256, respectively (slots and openings are not shown for main support rods 296 and 298 associated with assembly 270). The flange members disposed at the second ends of main support rods 248 and 250 (296 and 298) are received in the slots of upstanding supports 258 and 261 (302 and 306), respectively having openings (not shown for upstanding supports 258 and 261 but similar openings 304 and 308 are shown in upstanding supports 302 and 306 associated with assembly 270) for receiving therethrough main support rods 248 and 250 (296 and 298). The openings for the slots are slightly larger than the diameter of main support rods 248 and 250 (296 and 298) so that the main support rods can slide up and down within the openings but the flanges cannot pass through the openings. Main support rods 248 and 250 (296 and 298) have connected thereto drive motor 252 (300) which drives main support rods 248 and 250 (296 and 298) within the openings for assisting in centering cat's paw head 236 (286) for engaging the end of covered bale 106 and other purposes that will be described subsequently.

Again referring to the preferred embodiment of the process of the invention as carried out by the system shown in FIGS. 2, 3, 4 and 5, following the stopping step, cat's paw assembly 220 is driven by drive motors 242, 247 and 252, and cat's paw assembly 270 is driven by drive motors 290, 295 and 300 to center respective cat's paw heads 236 and 286 with respect to the opposing ends of covered bale 106 resting on conveyor 260. In this position, the respective cat's paw heads are centered but spaced away from the ends of the bale. After cat's paw heads 236 and 286 are in this position, drive motors 247 and 295 are activated to drive the respective cat's paw heads toward respective ends of covered bale 106 until the cat's paw heads engage the opposing ends of covered bale 106.

The method of engagement of an end of covered bale with cat's paw head 236 will now be described. Since both heads are substantially the same, the description of the engagement of one head is applicable to both cat's paw heads. Therefore, the reference numerals for cat's paw head 286 will be indicated in parenthesis following the reference numerals for the same element of cat's paw head 236.

Figure 4:
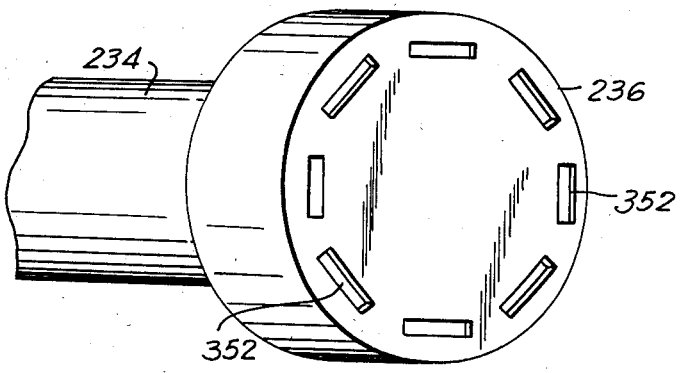
FIG. 4 shows an enlarged view of a cat's paw head shown in FIG. 3 with the cat's paw claws retracted.
Figure 5:
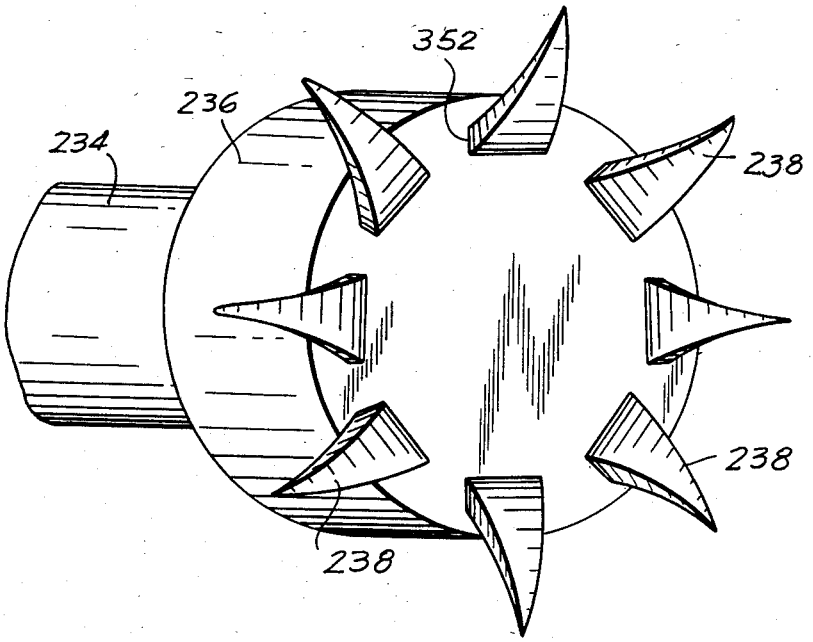
FIG. 5 shows an enlarged view of a cat's paw head shown in FIG. 3 with the cat's paw claws extended.

When cat's paw head 236 (286) is moved into engagement with an end of bale 106, the head is as shown in FIG. 4 with cat's paw claws 238 (288) (See FIG. 5) retracted within cat's paw head 236 (286). After cat's paw head 236 (286) engages the end of covered bale 106 with cat's paw claws 238 (288) retracted, cat's paw drive 224 (276) is activated to cause cat's paw claws 238 (288) to extend from head 236 (286) through openings 352 (not shown for head 286) as shown in FIG. 5. Cat's paw claws 238 (288), when extended from cat's paw head 236 (286), separately engage the burlap and loops of reinforcing string at the end of the covered tobacco bale.

Again referring to FIG. 3, subsequent to the engaging step, drive motors 252 and 300 are activated to drive main support rods 248 and 250, and 296 and 298, respectively, upward. This causes covered bale 106 to be lifted a predetermined distance above conveyor 260 held between cat's paw heads 236 and 286 so a subsequent rotating step can be carried out. As covered bale 106 is lifted, conveyor 260 pivots downwardly about one end exposing opening 118 below conveyor 260. The use of opening 118 will be described subsequently.

Once the the lifting step is completed, a cutting means, such as water knife assembly 201, is activated and moved to cutting position adjacent to the covered bale of tobacco. Water knife assembly 201, shown in FIG. 3, comprises water knife head 206 that is connected to two downwardly disposed control rod assemblies and a conventional control rod drive means (not shown). The control rod assemblies in conjunction with the conventional drive means (not shown) control the angular disposition of water knife head 206 and the distance water knife head 206 is from the covered bale.

Water knife head 206 has opposingly disposed standoff assemblies 208 and 210 connected thereto. Standoff assemblies 208 and 210 along with the coordinated movements of the control rod assemblies maintain the proper distance of the nozzle of water knife head 206 is from the outside burlap covering during the subsequent cutting step.

The first control rod assembly comprises rods 214 and 218 rotatably connected at coupling 216. The first end of rod 214 is connected to coupling 216, and the second end is connected to the top end of water knife head 206. The first end of rod 218 is connected to coupling 216 and the second end is connected to a drive means (not shown). The drive means connected to rod 218 drives rod 218 in the upward or downward direction to change the angular disposition of water knife head 206, and drives rod 218 pivotably about the drive means for moving water knife head 206 into and out of the cutting position adjacent to covered bale 106. The second central rod assembly comprises rod 202 and bracket 204. The first end of rod 202 is rigidly connected to bracket 204. The second end of rod 202 is pivotably fixed to a structural member of apparatus 110 above water knife assembly 201. The ends of "U" shaped bracket 204 point inwardly toward one another and are pivotably connected to opposite sides of water knife head 206 to serve as the pivot point of water knife head 206.

Referring to FIGS. 2 and 3, high pressure water supply system 112 provides high pressure water to water head 206 via transfer pipe 114 and high pressure line 115 connected between transfer pipe 114 and head 206. The high pressure water supplied to head 206 is in the range of 2000 to 55,000 psi. The nozzle of water knife head 206 has an exit orifice for the high pressure water with a diameter in the range of 5 to 8 microns. The high pressure water output from the nozzle forms thin, fine high pressure water stream 212 which is usable for cutting the covering material disposed on the underlying tobacco bale. The size of the exit orifice and pressure of the water are such that when the water knife head is in its cutting position adjacent to the covered bale, the effective cutting range of high pressure water stream 212, preferably, extends ¼ to ½ inches into the underlying bale of material. The benefit described subsequently.

Once again referring to the preferred embodiment of the process as carried out by the system, after the activating and moving step, covered bale 106 is rotated with water knife head 206 of water knife assembly 201 in the cutting position. Covered bale 106 is rotated by activation of cat's paw head rotation motors 226 and 274 of cat's paw assemblies 220 and 270, respectively. During the rotating step, high pressure water stream 212 from water knife head 206 cuts the burlap and loops of reinforcing string covering the bale of tobacco. During the cutting step, high pressure water stream 212 is, preferably, substantially normal to the burlap disposed on the outside of the bale of tobacco. High pressure water stream 212 is kept normal to the burlap on the outside of the tobacco bale by keeping both standoff assemblies in contact with the burlap. The standoff assemblies are kept in contact with the burlap by adjusting the position of water knife head 206 by use of the control rods assemblies attached to the water knife head and the drive means attached to control rod 218. The control rod assemblies and drive means constantly adjust the position of the water knife head so that it follows the contour of the rotating covered tobacco bale while keeping the high pressure water stream normal to the burlap.

During the cutting step, as the bale of tobacco is rotated, a single circumferential cut is made in the burlap thereby dividing it into two pieces. The loops of reinforcing string are also cut into two pieces as the bale rotates because the loops were oriented so that they were transverse to the path of travel of the water knife around the covered bale of tobacco in the orienting step. Although, the cutting step is described as being carried out by one water knife assembly, it is within the scope of the invention that more than one water knife assembly can be used. For example, a second water knife assembly can be activated and moved to a cutting position on an opposite side of the covered bale. In such an arrangement, the burlap and reinforcing string would be cut by both water knife assemblies. In such a case, the covered bale would only have to be rotated ½ a rotation for cutting the burlap and reinforcing string. Further, other combinations of a plurality of water knife assemblies can be used for carrying out the cutting step.

Since high pressure water stream 212 is used in the cutting step to cut the burlap and reinforcing string, there is minimal damage to the underlying material in the bale and the underlying bale is substantially free from contamination by particles, fragments and/or fibers of burlap and reinforcing string. There is minimal damage to the underlying tobacco bale since the effective cutting range of high pressure water stream 212 extends only ¼ to ½ inch into the bale material. The underlying bale of tobacco is substantially free from contamination by particles, fragments and/or fibers of the burlap and reinforcing string because the water stream is extremely fine thereby providing an extremely thin cutting means rather than a relative wide cutting means such as, for example, a circular saw blade, which can cause considerable contamination as previously stated.

Once the rotating step is completed, the bale is stopped by deactivating cat's paw rotation motors 226 and 274. Subsequent to the stopping step, water knife assembly 201 is deactivated and moved away from the cutting position. The water knife assembly is deactivated by any conventional means. Water knife assembly 201 is caused to move from the cutting position by activation of the drive means (not shown) connected to control rod 218. When activated, the drive means causes rod 218 to rotate about the drive means thereby causing water knife head 206 of water knife assembly 201 to move away from the cutting position to a noncutting position.

Following the deactivating and moving step, uncovering of the underlying bale of material takes place. The bale is uncovered by activating drive motors 247 and 295 to move cat's paw assemblies 220 and 270, respectively, away from the ends of the covered bale. When cat's paw assemblies 220 and 270 move away from bale 106, cat's paw claws 238 of cat's paw head 236 and cat's paw claws 288 of cat's paw head 286 are in their extended positions engaging the burlap and reinforcing string at the respective ends of the bale. Therefore, as the respective cat's paw assemblies are moved away from the ends bale 106, the burlap half and cut loops of reinforcing string associated with respective sides of the bale are removed from the underlying tobacco bale. As the respective cat's paw assemblies with the respectively engaged burlap halves and cut loops of reinforcing string are moved away from the underlying bale, a point is reached when the underlying bale of tobacco will fall free of the burlap halves and cut reinforcing string into opening 118 below apparatus 110, thereby removing the uncovered bale of tobacco from apparatus 110. These uncovered bales are then transported to other locations for further processing in the production of tobacco products.

Once the uncovering step and the removal step have been completed, the burlap halves and cut reinforcing string are released by cat's paw heads 236 and 286, respectively. The method in which the burlap halves and cut reinforcing string are released by the respective cat's paw heads will now be described. Following removal of the uncovered bale from apparatus 110, conveyor 260 is rotated back to its original position flush with conveyors 104 and 108. After this, drive motors 247 and 295 of cat's paw assemblies 220 and 270, respectively, are activated to move the respective assemblies toward conveyor 260 to a point in which cat's paw heads 236 and 286 with the respective burlap halves and cut reinforcing string attached thereto are over conveyor 260. Once in this position, cat's paw drives 224 and 276 are activated to retract cat's paw claws 238 and 288 into cat's paw heads 236 and 286, respectively.

When the cat's paw claws of the respective heads are retracted, the burlap halves and cut reinforcing string are released from the respective heads and fall to conveyor 260.

Following the releasing step, the burlap halves and cut reinforcing string are removed from apparatus 110. The removal of the burlap halves and cut reinforcing string 120 are carried out by transporting them via conveyor 260 to conveyor 108. Once on conveyor 108 burlap halves and cut reinforcing string 120 are removed from apparatus 110, as shown in FIG. 2. Once the foregoing process has been carried out by the system, the system is ready to repeat the process on the next covered bale 106.

The system for carrying out the process of the invention carries out all of the steps of the process within deburlapping and destringing apparatus 110 in 20 seconds or less.

Figure 6:
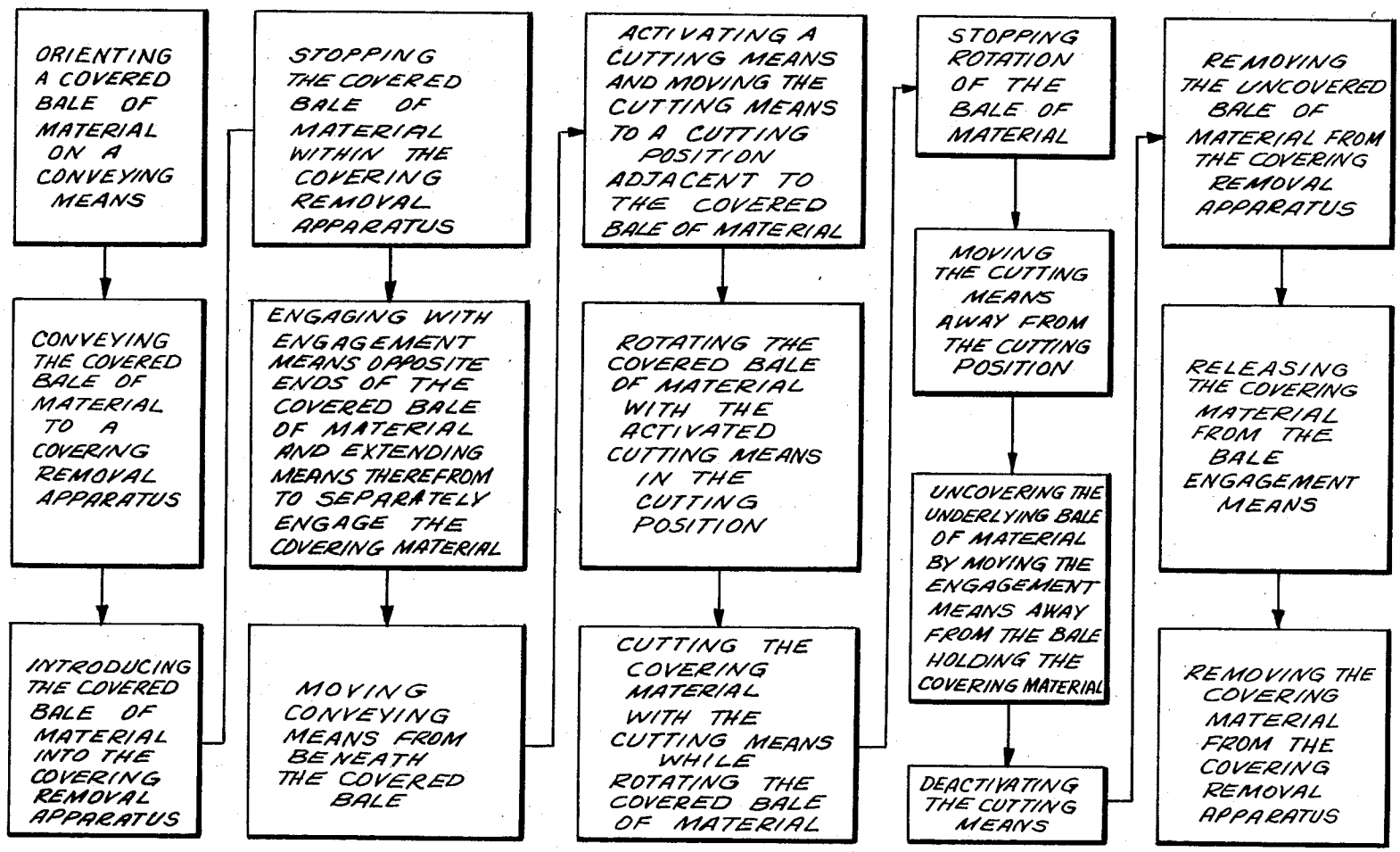
FIG. 6 shows a block diagram of the second embodiment of the process of the invention.

Referring to FIG. 6, the second embodiment of the process of the invention will be described.

According to the second embodiment of the process of the invention, a covered bale is removed from its place of storage and oriented on a conveying means such that the loops of reinforcing string are transverse to the direction of travel of the covered bale on the conveying means. The bale is oriented in this manner so that the loops of reinforcing string will be transverse to the path of travel of the cutting means around the bale in a subsequent cutting step. Upon completion of the orienting step, the covered bale is conveyed to a covering removal apparatus on the conveying means. Following the conveying step, the covered bale is introduced into a covering removal apparatus. The covered bale is introduced into the covering removal apparatus on and by the conveying means. Once the introducing step is completed, the covered bale is stopped within the covering removal apparatus. The covered bale is stopped within the covering removal apparatus by stopping the conveying means once the bale is within the covering removal apparatus. When the stopping step is completed, the opposite ends of the covered bale are engaged by one of a pair of engagement means and means are extended from the respective engagement means that separately engage the covering material disposed at the respective ends of the bale. After the engagement step, a portion of the conveying means is moved from beneath the covered bale. Subsequent to completing the moving step for moving the conveying means from beneath the covered bale, a water knife is activated and moved to a cutting position adjacent to the covered bale. As the the activating and moving step reaches completion, the covered bale is rotated with the activated water knife in the cutting position. During the rotating step, the water knife cuts through the thicknesses of covering material covering the bale. Following the rotating step and the cutting step, rotation of the bale is stopped. The rotation of the bale is typically stopped after one rotation of the bale since the water knife will have made at least one circumferential trip around the covered bale cutting the covering material in its path of travel. Once the stopping step is over, the water knife is moved from its cutting position adjacent to the bale to a noncutting position. When the water knife is moved during this step it is still activated. After the moving step for moving the water knife away from the cutting position, the covered bale is uncovered. The underlying bale is uncovered by moving the pair of engagement means away from the underlying bale with the cut covering material stil engaged by the engagement means, however, during this step the the conveyor means has again been disposed beneath the covered bale. Following the uncovering step, the water knife is deactivated. The deactivating step is initiated during a removing step for removing the uncovered bale from the covering removal apparatus. During the deactivating step and/or the removing step, the cut covering material is released from the pair of engagement means, respectively. Once the releasing step is completed, the cut covering material is removed from the covering removal apparatus and apparatus is ready to receive the next covered bale.

Figure 7:
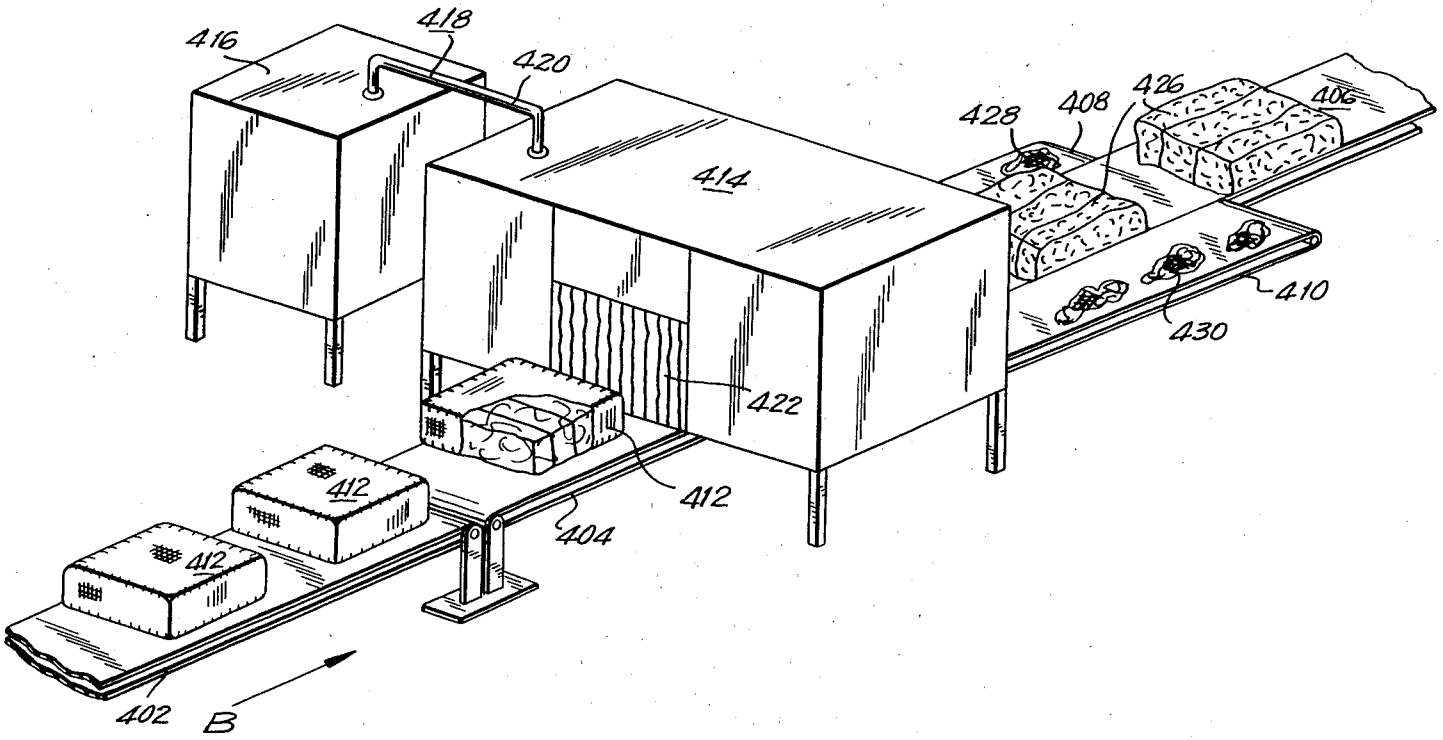
FIG. 7 shows a system for carrying out the second embodiment of the process of the invention.
Figure 8:
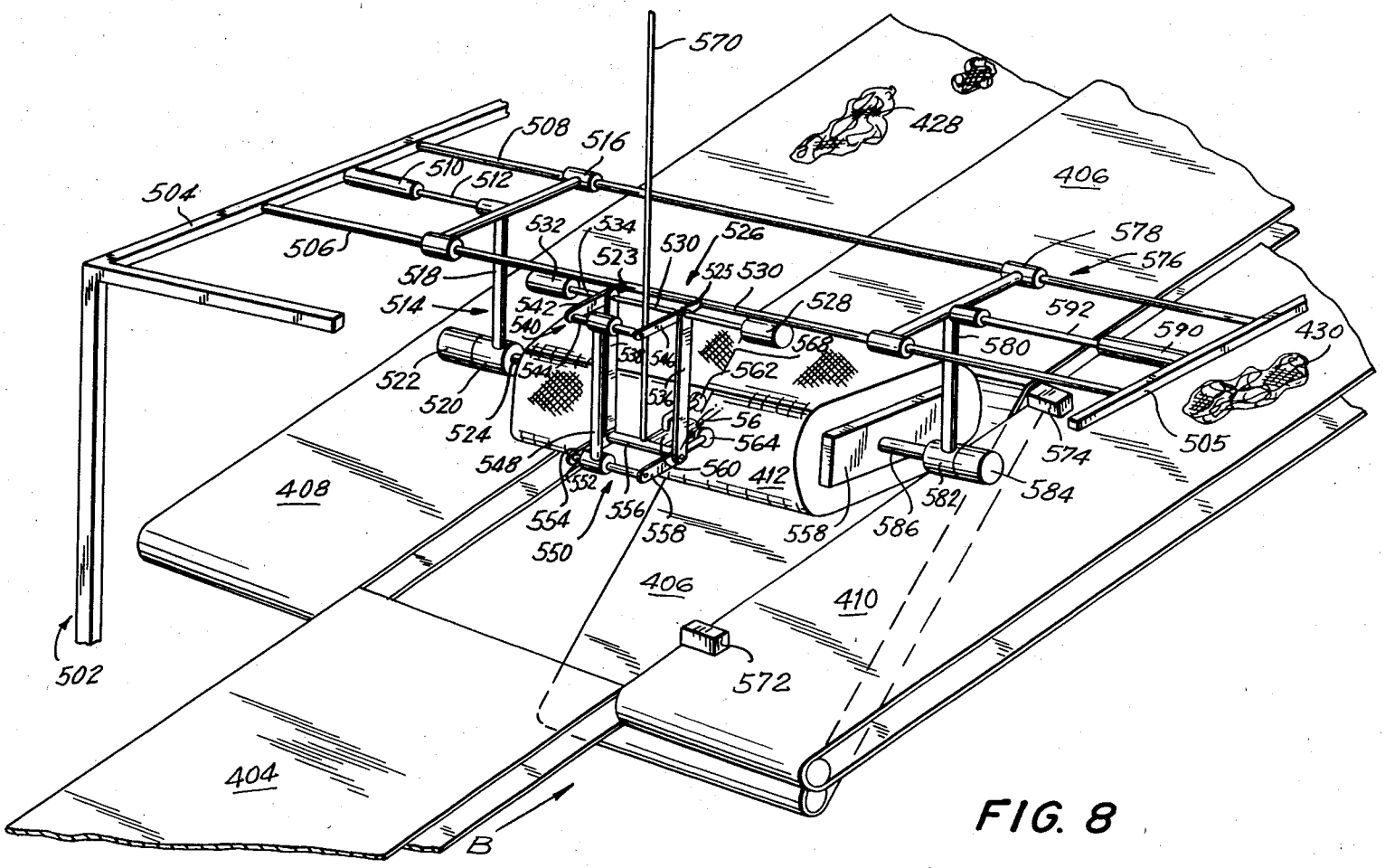
FIG. 8 shows the operating assemblies within the deburlapping and destringing apparatus of the system shown in FIG. 6.

Referring to FIGS. 7 and 8, the system for carrying out the second embodiment of the process of the invention will be described.

The system for carrying out the second embodiment of the process of the invention comprises conveyors 402, 404, 406, 408 and 410, deburlapping and destringing apparatus 414, and high pressure water supply system 416.

In accordance with the second embodiment of process of the invention, covered bale 412 is removed from a place of storage and oriented on conveyor 402 so that the loops of reinforcing string are transverse to the direction of movement B of the bale. The bale is oriented in this manner so that the loops of the reinforcing string will be transverse to the direction of travel of the cutting means during the cutting step of the process described subsequently.

After the orienting step, covered bale 412 is conveyed by conveyors 402 and 404 to deburlapping and destringing apparatus 414. Following the conveying step, covered bale 412 is introduced into apparatus 414 on conveyor 404. In being introduced into apparatus 414, covered bale 412 passes through a set of flexible drapes 422 disposed across the entrance opening of apparatus 414. Although not shown, a similar set of flexible drapes is disposed across the exit opening of apparatus 414. The drapes across the entrance and exit openings keep the dust and moisture generated by the operation of apparatus 414 within apparatus 414.

After the introducing step, covered bale 412 is transferred to conveyor 406 and stopped within the apparatus 414 on conveyor 406. Conveyor 406 is automatically stopped a predetermined time interval after the trailing edge of covered bale 412 passes sensor 572 disposed adjacent to conveyor 406. Sensor 572 is fixed to the frame of apparatus 414 in an conventional manner.

After the stopping step in which covered bale 412 is stopped within apparatus 414, the respective ends of the covered bale are engaged by one of a pair of engagement means such as the cat's paw box (not shown) of cat's paw assembly 514 and cat's paw box 588 of cat's paw assembly 576. Cat's paw assemblies 514 and 576 are disposed on main support rods 506 and 508 connected between opposing members 504 and 505 of frame 502, shown in part in FIG. 8. The opposing cat's paw assemblies 514 and 576 are mirror images of one another. Assembly 576 is more completely shown in FIG. 8 than assembly 514. Therefore, assembly 576 will be described and the reference numerals for the corresponding element of assembly 514 will be indicated in parenthesis following the reference numeral of the same element of assembly 576.

Cat's paw assembly 576 (514) has main support rod traveler 578 (516) which is slidably disposed on main support rods 506 and 508. Pneumatic cylinder 590 (510)

is connnected to the central portion of main support rod traveler 578 (516) via push rod 592 (512). Pneumatic cylinder 590 (510) has an opposite end fixed to structural member 505 (504) of frame 502. Pneumatic cylinder 590 (510) when actuated will cause main support rod traveler 578 (516) to move along main support rods 506 and 508.

Downwardly disposed from main support rod traveler 578 (516) is traveler post 580 (518). Disposed at the distal end of traveler post 580 (518) is drive shaft sleeve 582 (520). Disposed through drive shaft sleeve 582 (520) is cat's paw drive shaft 586 (524). Cat's paw drive shaft 586 (524) is connected between cat's paw box 588, (not shown for assembly 514) and cat's paw rotation motor 584 (522) disposed on the opposite side of drive shaft sleeve 582 (520). By drive shaft 582 (524) being disposed through drive shaft sleeve 582 (520), the drive shaft sleeve supports drive shaft 586 (524), cat's paw rotation motor 584 (522) and cat's paw box 588 (not shown for assembly 514).

Cat's paw box 588 (not shown for assembly 514) is substantially similar to the cat's paw head described in the system for carrying out the preferred embodiment of the process of the invention, except the cat's paw box is rectangular rather than circular in shape. The cat's paw box, like the cat's paw head, has cat's paw claws which are capable of being extended from and retracted into the cat's paw box for carrying out steps of the process of the invention. Therefore, after the stopping step in which covered bale 412 is stopped within apparatus 414, and after pneumatic cylinders 510 and 590 of cat's paw assemblies 514 and 576, respectively, are activated causing the respective cat's paw boxes to engage the ends of the covered bales, the cat's paw claws are extended from the respective cat's paw boxes to separately engage the burlap and loops of reinforcing string at the respective ends of the tobacco bale.

Upon completion of the engaging step, a first end of conveyor 406, which is beneath covered bale 412, is moved from beneath covered bale 412. Typically, the first end of conveyor 406 is moved from beneath covered bale 406 by rotating it downwardly about an idler roller (not shown). When the first end of conveyor 406 is rotated downwardly about an idler roller, the bale will remain in place because it is held between the two cat's paw assemblies 514 and 576. The first end of the conveyor 406 is rotated downwardly so that the covered bale will be able to be rotated during a subsequent rotating step.

During the moving step in which the first end of conveyor 406 is moved from beneath the covered bale 412 held between cat's paw assemblies 514 and 576, water knife assembly 526 is activated and moved to a cutting position adjacent to covered bale 412. Water knife assembly 526 is activated a predetermined time interval after the trailing edge of covered bale 406 passes sensor 572. This time interval is longer than the time interval in which conveyor 406 is stopped to stop covered bale 406 within apparatus 414. When water knife assembly 526 is first activated, water knife head 560 is in a noncutting position. In the noncutting position, water knife head 560 is rotated away from the covered bale. Following activation of water knife assembly 526, water knife head 560 is moved to the cutting position as shown in FIG. 8.

Water knife assembly 526 will now be described. Water knife assembly 526 is rotatably connected to brackets 523 and 525 disposed perpendicularly from and fixed to main support rod 506. Drive shaft 530 of standoff motor 528 is the main support shaft for water knife assembly 526 which is rotatably connected to brackets 523 and 525. Fixedly attached to drive shaft 530 are downwardly extending members 536 and 538. Since downwardly extending members 560 and 562 are fixedly attached to drive shaft 530, activation of standoff motor 528 will cause water knife assembly 526 to rotate about the rotatable connection between drive shaft 530 at brackets 523 and 525, as will be described.

Drive shaft 534 of water knife head angular disposition motor 532 is fixed attached to side member 542 of "U" shaped member 540 comprising side members 542 and 546, and rod 544 connecting the two side members. Second side member 546 is rotatably attached to standoff motor drive shaft 530. Activation of the angular disposition motor will cause changes in the angular disposition of water knife head 560, as will be described.

Rotatably disposed on rod 544 of "U" shaped member 540 is the first end of follower link 548. The other end of follower link 548 is rotatably disposed on rod 552 of the rectangular water knife head mounting member 550. Mounting member 550 comprises opposing disposed rods 552 and 556 whose respective ends are connected by side members 554 and 558. Rod 556 of mounting member 550 has water knife head 560 fixedly attached thereto. Mounting member 550, at the positions where side members 554 and 558 are fixed to rod 556, is rotatably connected to the distal ends of downwardly extending members 536 and 538, respectively. This connect allows rotation of the mounting member for angular movement of head 560.

When water knife assembly 526 is activated, it is in the noncutting position previously described. After activating the assembly, standoff motor 528 is activated causing members 536 and 538 to rotate downwardly about brackets 523 and 525 toward covered bale 412. As water knife head 560 moves adjacent to the outer burlap covering, angular disposition motor 532 is activated causing the angular position of head 560 to be adjusted so standoff assemblies 562 and 564 of water knife head 560 both contact the outer burlap covering. Once this takes place, water knife head 560 is in the cutting position with the high pressure water stream 568 substantially normal to the surface of the burlap.

Water knife assembly 526 within apparatus 414 has high pressure water supplied by high pressure water supply system 416. Supply system 416 supplies high pressure water in the range of 2000 to 55,000 psi. The high pressure water is supplied to water knife head 560 via transfer pipe 418 and high pressure water line 570 connected between transfer pipe 418 and water knife head 560. The nozzle of water knife head 560 has an exit orifice with a diameter in the range of 5 to 8 microns. The water pressure and orifice size are such that when the water knife head is in the cutting position with high pressure water stream 566 normal to the outer burlap covering, the effective cutting range of high pressure water stream 566 extends $\frac{1}{4}$ to $\frac{1}{2}$ inches into the underlying tobacco bales.

After the activation and moving step, the bale is rotated with the water knife in the cutting position. The bale is rotated by activating cat's paw box rotation motors 522 and 584 of cat's paw assemblies 514 and 576, respectively. During the rotating step, water knife head 560 is in the cutting position and high pressure water stream 562 makes a single circumferential cut in the burlap separating it into two pieces and cuts each loop of reinforcing string into two pieces. While the bale rotates, standoff motor 528 and angular disposition motor 532 are activated as necessary to keep both standoff assemblies 562 and 564 in contact with the burlap thereby keeping the high pressure water stream normal to the burlap. The use of the water knife to cut the covering material during the cutting step will cause minimal damage to and contamination of the underlying tobacco.

After the rotating step and cutting step, rotation of the bale is stopped. After the stopping step in which rotation of bale is stopped by deactivating rotation motors 522 and 584, water knife head 560 is moved away from the bale. To move water knife head 560 away from the covered bale and from the cutting position, standoff motor 528 is activated causing downwardly extending members 536 and 538 to be rotated away from the bale.

Following the moving step for moving water knife head 560 from the cutting position, the underlying bale is uncovered. In order to uncover the underlying bale, pneumatic cylinders 510 and 590 are actuated causing the cat's paw assemblies 514 and 576 to move in respective directions away from the ends of the bale. During this movement, the respective burlap halves and cut loops of reinforcing string remain engaged by the extended cat's paws of the respective cat's paw boxes. During initiation of this step or immediatey following the stopping step, the first end of conveyor 406 is rotated upwardly so that it is again beneath covered bale 412. Therefore, when the burlap halves and cut loops of reinforcing string are pulled from the underlying bale, the underlying bale will rest upon conveyor 406.

Subsequent to the uncovering step, uncovered bale 426 is conveyed in direction B on conveyor 406 for removal from the apparatus. By the time the bale burlap and reinforcing string are removed from the underlying bale, conveyor 406 has been automatically started to convey uncovered bale 426 in direction B. As uncovered bale 426 passes sensor 574, which like sensor 572 is fixed to the frame of the apparatus by conventional means, the water knife assembly is caused to be deactivated. After the deactivating step, uncovered bale 426 is removed from apparatus 412 via conveyor 406 for further processing in the production of tobacco products.

During the removing step for removing uncovered bale 426 from apparatus 414, cat's paw assemblies 514 and 576 continue to move in their respective directions farther away from conveyor 406 for releasing of the burlap halves and cut reinforcing string from the respective cat's paw boxes. Once the burlap halves and cut reinforcing string engaged by the cat's paw claws of the respective cat's paw boxes are moved over conveyors 408 and 410, respectively, the cat's paw claws of the respective cat's paw boxes are retracted into the cat's paw boxes thereby releasing the burlap half and cut loops of reinforcing string from the respective cat's paw boxes. Upon release, the respective burlap halves cut loops of reinforcing string 428 and 430 which fall to conveyors 408 and 410, respectively.

After the releasing step, the burlap halves and cut loops of reinforcing string are removed from apparatus 414. Burlap half and cut reinforcing string 428 released from the cat's paw box of cat's paw assembly 514 are removed from apparatus 414 on conveyor 408, and burlap half and cut reinforcing string released from cat's paw box 588 of cat's paw assembly 576 are removed from apparatus 414 on conveyor 410. Following removal of the burlap halves and reinforcing string, the system is ready to carry out the second embodiment of the process of the invention on the next covered bale.

The steps of the process which take place within apparatus 414 are carried out in 20 seconds or less.

The terms and expressions which are employed here are used as terms of description and not of limitation. And there is no intention, in the use of such terms and expressions, of excluding the equivalents of the features shown and described, or portions thereof, it being recognized that various modifications are possible in the scope of the invention as claimed.

We claim:

1. A process for removing covering material from a bale of material comprising the steps of orienting a covered bale of material on a conveying means;

conveying the covered bale of material with the conveying means to a covering removal apparatus;

introducing the covered bale of material into the covering removal apparatus on the conveying means;

stopping the covered bale of material within the covering removal apparatus;

engaging each opposing end of the covered bale of material, respectively, with one of a pair of engagement means and extending means from each of the engagement means to separately engage the covering material;

lifting the covered bale of material held between the pair of engagement means;

activating at least one water knife and moving the water knife from a noncutting position to a cutting position adjacent to the covered bale of material;

rotating the covered bale of material held between the pair of engagement means with the water knife in the cutting position;

cutting the covering material with water knife during the rotating step and causing only minimal damage to the underlying bale of material and only minimal contamination of the underlying bale of material with particles, fragments and/or fibers of the covering material;

stopping rotation of the covered bale of material after a predetermined number of revolutions;

deactivating the water knife and moving the water knife from the cutting position to the noncutting position;

uncovering the underlying bale of material by moving the respective engagement means away from the opposing ends of the underlying bale of material while still engaging the covering material with the means extended from each of the engagement means;

removing the uncovered bale of material from the covering removal apparatus;

releasing the covering material from the engagement means; and removing the covering material from the covering removal apparatus.

2. The process as recited in claim 1, wherein the covering material further comprises a plurality of parallel spaced apart loops of reinforcing string disposed on the underlying bale of material, and burlap material disposed over the plurality of loops of reinforcing string and the underlying bale of material whereby during the orienting step the covered bale of material is oriented so that the plurality of loops of reinforcing string will be transverse to a path of travel of the water knife around the covered bale of material when the covered bale of material is rotated during the rotating step with the water knife in the cutting position.

3. The process as recited in claim 2, wherein during the cutting step the water knife makes a single continuous circumferential cut in the burlap material, and cuts each of the plurality of loops of reinforcing string twice in the circumferential movement of the water knife relative to the bale of material.

4. The process as recited in claim 1, wherein the steps of the process except for the orienting step and conveying step are accomplished in 20 seconds or less.

5. The process as recited in claim 1, wherein the covered bale of material includes a bale of tobacco leaves.

6. The process as recited in claim 5, wherein the bale of tobacco leaves includes a bale of Oriental tobacco leaves.

7. The process as recited in claim 1, wherein the releasing step includes the step of retracting the means extended from the engagement means into the engagement means.

8. The process as recited in claim 1, wherein a plurality of water knives are used for cutting the covering material during the cutting step.

9. The process as recited in claim 1, wherein during the introducing step the covered bale passes through a set of flexible drapes.

10. A process for removing covering material from a bale of material comprising the steps of:

orienting a covered bale of material on a conveying means;

conveying the covered bale of material with conveying means to a covering removal apparatus;

introducing the covered bale of material into the covering removal apparatus on the conveying means;

stopping the covered bale of material within the covering removal apparatus;

engaging each opposing end of the covered bale of material, respectively, with one of a pair of engagement means and extending means from each of the engagement means to separately engage the covering material;

moving the conveying means from beneath the covered bale of material;

activating at least one water knife and moving the water knife from a noncutting position to a cutting position adjacent to the covered bale of material;

rotating the covered bale of material held between the pair of engagement means with the water knife in the cutting position;

cutting the covering material with the water knife during the rotating step and causing only minimal damage to the underlying bale of material and only minimal contamination of the underlying bale of material with particles, fragments and/or fibers of the covering material;

stopping rotation of the covered bale of material after a predetermined number of revolutions;

moving the water knife from the cutting position to the noncutting position;

uncovering the underlying bale of material by moving the respective engagement means away from the opposing ends of the underlying bale while still engaging the covering material with the means extended from each of the engagement means with the conveying means moved back beneath the covered bale;

deactivating the water knife;

removing the uncovered bale from the covering removal apparatus;

releasing the covering material from the pair engagement means; and removing the covering material from the covering removal apparatus.

11. The process as recited in claim 10, wherein the covering material further comprises a plurality of parallel spaced apart loops of reinforcing string disposed on the underlying bale of material, and burlap material disposed over the plurality of loops of reinforcing string and the underlying bale of material whereby during the orienting step the covered bale of material is oriented so that the plurality of loops of reinforcing string will be transverse to a path of travel of the water knife around the covered bale of material when the covered bale of material is rotated during the rotating step with the water knife in the cutting position.

12. The process as recited in claim 11, wherein during the cutting step the water knife makes a single continuous circumferential cut in the burlap material and cuts each of the plurality of loops of reinforcing string twice in the circumferential movement of the water knife relative to the bale of material.

13. The process as recited in claim 10, wherein the steps of the process except for the orienting step and conveying step are accomplished in 20 seconds or less.

14. The process as recited in claim 10, wherein the covered bale of material includes a bale of tobacco leaves.

15. The process as recited in claim 14, wherein the bale of tobacco leaves includes a bale of Oriental tobacco leaves.

16. The process as recited in claim 10, wherein the releasing step includes the step of retracting the means extended from the engagement means into the engagement means.

17. The process as recited in claim 10, wherein a plurality of water knives are used for cutting the covering material during the cutting step.

18. The process as recited in claim 10, wherein during the introducing step the covered bale passes through a set of flexible drapes.

* * * * *